US007914669B2

(12) United States Patent
Martinie et al.

(10) Patent No.: US 7,914,669 B2
(45) Date of Patent: Mar. 29, 2011

(54) REACTIVE EXTRACTION OF SULFUR COMPOUNDS FROM HYDROCARBON STREAMS

(75) Inventors: Gary Dean Martinie, Pompano Beach, FL (US); Farhan M. Al-Shahrani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 582 days.

(21) Appl. No.: 10/583,784

(22) PCT Filed: Dec. 22, 2004

(86) PCT No.: PCT/US2004/043718

§ 371 (c)(1),
(2), (4) Date: May 17, 2007

(87) PCT Pub. No.: WO2005/066313

PCT Pub. Date: Jul. 21, 2005

(65) Prior Publication Data

US 2007/0227950 A1 Oct. 4, 2007

Related U.S. Application Data

(60) Provisional application No. 60/532,742, filed on Dec. 24, 2003.

(51) Int. Cl.

| | |
|---|---|
| ***C10G 21/08*** | (2006.01) |
| ***C10G 21/20*** | (2006.01) |
| ***C07C 7/10*** | (2006.01) |

(52) U.S. Cl. ..... 208/208 R; 208/219; 208/226; 208/244; 208/298; 585/868

(58) Field of Classification Search ..... 208/208 R, 208/219, 226, 237, 244, 223, 280, 298; 585/833, 585/868

See application file for complete search history.

(56) References Cited

U.S. PATENT DOCUMENTS

| | | | |
|---|---|---|---|
| 723,368 | A | 3/1903 | Colin et al. |
| 1,435,824 | A | 11/1922 | Dunstan |
| 1,783,901 | A | 12/1930 | Bottoms |
| 2,915,461 | A | 12/1959 | Davies et al. |
| 2,944,010 | A | 7/1960 | Webber |
| 3,306,945 | A | 2/1967 | Conviser |
| 3,367,862 | A | 2/1968 | Mason et al. |
| 3,756,976 | A | 9/1973 | Uraneck et al. |
| 3,898,153 | A | 8/1975 | Louder et al. |
| 4,035,474 | A | 7/1977 | Kunkel et al. |
| 4,075,094 | A | 2/1978 | Carlson |
| 4,225,417 | A | 9/1980 | Nelson |
| 4,283,373 | A | 8/1981 | Frech et al. |
| 4,320,220 | A | 3/1982 | Pampouchidis |
| 4,456,527 | A | 6/1984 | Buss et al. |
| 4,464,246 | A | 8/1984 | Sanda |

(Continued)

FOREIGN PATENT DOCUMENTS

| | | | |
|---|---|---|---|
| GB | 2 166 453 | A | 5/1986 |

(Continued)

*Primary Examiner* — Walter D Griffin
*Assistant Examiner* — Renee Robinson
(74) *Attorney, Agent, or Firm* — Abelman, Frayne & Schwab

(57) ABSTRACT

A process to substantially reduce the sulfur content of a liquid hydrocarbon stream by contacting the hydrocarbon stream with an aqueous stream containing a mixture of one or more extraction agents selected from hypochlorites, cyanurates and alkali metal and alkaline earth metal hydroxides, optionally in the presence of a catalyst, to remove sulfur compounds.

17 Claims, 2 Drawing Sheets

U.S. PATENT DOCUMENTS

| | | | | |
|---|---|---|---|---|
| 4,473,115 | A * | 9/1984 | Oakes | 175/40 |
| 4,504,287 | A | 3/1985 | Atlani et al. | |
| 4,534,943 | A | 8/1985 | Novak et al. | |
| 4,575,415 | A | 3/1986 | Novak et al. | |
| 4,592,829 | A * | 6/1986 | Eberly, Jr. | 208/89 |
| 4,592,892 | A | 6/1986 | Euno et al. | |
| 4,634,518 | A | 1/1987 | Buss et al. | |
| 4,816,139 | A | 3/1989 | Keyworth | |
| 5,087,350 | A | 2/1992 | Paris-Marcano | |
| 5,167,797 | A | 12/1992 | Ou | |
| 7,001,504 | B2 * | 2/2006 | Schoonover | 208/236 |
| 2002/0172630 | A1 | 11/2002 | Ahmed et al. | |
| 2002/0174603 | A1 | 11/2002 | Ahmed et al. | |
| 2004/0007501 | A1 * | 1/2004 | Sughrue et al. | 208/208 R |
| 2004/0163311 | A1 | 8/2004 | Ahmed et al. | |

FOREIGN PATENT DOCUMENTS

| | | | |
|---|---|---|---|
| GB | 2 209 386 | A | 5/1989 |

* cited by examiner

REACTIVE EXTRACTION OF SULFUR COMPOUNDS FROM HYDROCARBON STREAMS

CROSS REFERENCE TO RELATED APPLICATIONS

This application is entitled to the benefit of Provisional Application Ser. No. 60/532,742, filed Dec. 24, 2003, the disclosure of which is incorporated herein by reference.

BACKGROUND OF THE INVENTION

1. Field of the Invention

The present invention relates to a process for the reduction of sulfur compounds in various hydrocarbon streams and, more particularly, to a liquid-liquid extraction of a hydrocarbon liquid phase with an aqueous phase.

2. Related Art

The removal of sulfur compounds from gas streams has been of considerable importance in the past and is even more so today due to environmental considerations. Gas effluent from the combustion of organic materials, such as coal, almost always contain sulfur compounds and sulfur removal processes have concentrated on removing hydrogen sulfide since it has been considered a significant health hazard, and also because it is corrosive, particularly when water is present. With increasing emphasis on eliminating or minimizing sulfur discharge to the atmosphere, attention is now turning to the removal of other sulfur compounds from gas streams.

Numerous natural gas wells produce what is called in the industry "sour gas." "Sour gas" is natural gas that contains hydrogen sulfide, mercaptans, sulfides and disulfides in concentrations that make its use unacceptable. Considerable effort has been expended to find an effective and cost efficient means to remove these objectionable sulfur compounds from natural gas.

The removal of sulfur compounds and particularly chemically-combined sulfur, such as organosulfur compounds, from feedstreams is highly desirable to satisfy environmental regulations and in order to prevent potential catalyst deactivation, as well as equipment corrosion.

Typically, hydrocarbon products contain various amounts of sulfur compounds in the form of, for example, chemically-combined sulfur, such as inorganically combined sulfur and organically combined sulfur.

The presence of organosulfur compounds in hydrocarbon streams occurs naturally, as well as from the introduction of organosulfur compounds into the hydrocarbon streams during conventional processes for the production and treating of hydrocarbon products.

As previously indicated, if chemically-combined sulfur, such as organosulfur compounds, are not removed from the hydrocarbon streams, the presence of organosulfur compounds in the resultant hydrocarbon products, including natural gas, paraffins, olefins and aromatics, particularly gasoline or other fuels, can cause corrosion of processing equipment and engine parts, as well as other deleterious effects, particularly when water is present.

A number of processes are available for the removal of $H_2S$ from natural gas streams. The processes which are presently available can be categorized as those based on physical absorption, solid adsorption, or chemical reaction.

Physical absorption processes suffer from the fact that they frequently encounter difficulty in achieving the low concentrations of $H_2S$ required in the sweetened gas stream.

Solid bed adsorption processes suffer from the fact that they are generally restricted to low concentrations of $H_2S$ in the entering sour gas stream. Chemically reactive processes in general are able to meet sweet gas $H_2S$ concentration standards with little difficulty; however, they suffer from the fact that a material that will react satisfactorily with $H_2S$, will also react with $CO_2$. Above all, the processes presently available do not efficiently provide for removal of mercaptans, sulfides and disulfides.

An example of a chemically reactive process is the ferric oxide fixed bed process, wherein the reactive entity is ferric oxide impregnated on an inert carrier. This process is effective for the removal of $H_2S$, but does not appreciably remove mercaptans or other sulfur compounds. While the bed can be regenerated, the number of regenerations is limited by the build-up of elemental sulfur upon the bed.

A widely used process for removing $H_2S$ from natural gas depends upon the reactivity of $H_2S$ with amino nitrogen. (See for example U.S. Pat. No. 1,783,901, the disclosure of which is incorporated by reference.) Amine-containing chemical compounds which are currently being employed for removal of $H_2S$ from gas streams include: monoethanolamine, 2-(2-aminoethoxy)ethanol and diethanolamine. While effective for the removal of $H_2S$, these compounds do not effectively remove mercaptans, sulfides or disulfides. Installation costs are high and operating costs are also high due to substantial energy requirements.

The Shell Oil Company's "Sulfinol" process involves both a physical solvent and a chemically reactive agent in the sweetening solution. The physical solvent involved is tetrahydrothiophene 1,1-dioxide and the amine is usually diisopropylamine. This process suffers from the disadvantage that the physical solvent has a high absorption capacity for the hydrocarbon gas constituents and the cost per unit is excessive.

In general, amine type sweetening processes tend to encounter the same kinds of operating problems, which can be roughly categorized as (a) solution loss, (b) foaming and (c) corrosion. In the presence of water, $H_2S$ is corrosive. Thus, elimination of corrosion in an amine sweetening unit is all but impossible because most amine type solvents are used in water solution.

Activated carbon and molecular sieves are well-known, however, absorption capacities are limited. Regeneration is possible, but this requires sophisticated instrumentation and controls in addition to high energy requirements.

U.S. Pat. No. 4,035,474 to Kunkel et al., the disclosure of which is incorporated by reference, discloses a method for the removal of sulfur from tail gas by use of a cold bed absorption process. While this process utilizes a catalyst, catalyst deactivation occurs after 18 hours, and a backup unit must be brought on stream while the spent catalyst is regenerated for 12 to 14 hours at 700° F./370° C.

The reaction of alkali metal salts of sulfonamides with sulfur compounds is known. For example, a kinetic study of the reaction between sulfides and N-sodium-N-chloro-paratoluene sulfonamide is reported in the Bull. Chemical Society Japan, V.42, 2631 (1969), K. Tsujihara, et al. From the mechanistic study of this reaction, a procedure for the synthesis of sulfilimines was devised.

A process is disclosed in U.S. Pat. No. 3,756,976 to Uranek et al., the disclosure of which is incorporated by reference, which removes objectionable thiol odor from polymer latex through the use of numerous compounds that convert the odorous sulfar compounds to a nonodorous form.

The use of the alkali metal salts of N-halogenated arylsulfonamides, U.S. Pat. No. 3,756,976, teaches the use of the compounds of Uranek '976 to convert sulfur compounds to a nonodorous form and not the removal thereof. The process discloses the presence of converted sulfur compounds within the polymer latex system, but does not teach or suggest that sulfur compounds can be removed from a gas stream through the use of the alkali metal salts of N-halogenated sulfonamides.

The reaction of sulfides with salts of N-chloroarenesulfonamides was the first method to be discovered for preparing sulfilimines. Gilchrist et al, Chem. Rev., Vol. 77, No. 3, page 409, 1977.

The reaction of Chloramine-T (trademark for N-sodium-N-chloro paratoluene sulfonamide) with thiols, disulfides, sulfides, sulfoxides and sulfones was reported by D. K. Padma et al, in Int. J. Sulfur Chem., Part A 1971, 1(4), 243-50 and titrimetric determination of mercaptans with chloramine-T is reported by R. C. Paul et al. in Talanta, 1975, 22(3), 311-12. These references do not suggest or disclose that salts of sulfonamides, such as chloramine-T can be used to remove sulfur compounds from a gas stream.

U.S. Pat. No. 4,283,373 to Frech et al., the disclosure of which is incorporated by reference, discloses a method of removing sulfur compounds from a gas stream by contacting the stream with alkali metal salts of sulfonamides. The preferred sulfonamide disclosed is chloramine-T which can be sprayed into the gas stream, or the gas can be passed through a porous carrier impregnated with the chloramine, or through a resin with pendant substituted sulfonamide groups.

U.S. Pat. No. 3,306,945 to Conviser, the disclosure of which is incorporated by reference, is directed to a process for purifying liquid unsaturated hydrocarbons by removing impurities using molecular sieve materials. This patent discloses that sulfides (R—S—R), which include dialkyl sulfides, may be adsorbed by zeolitic molecular sieves material having sufficiently large pores to capture such impurities, such as synthetic type X.

U.S. Pat. No. 4,592,892 to Eberly, Jr., the disclosure of which is incorporated by reference, discloses a process of using a sorbent catalyst to remove sulfur from naphtha. The sulfur impurities which are disclosed as being removed are mercaptans, thiophenes, disulfides, thioethers, hydrogen sulfide, carbonyl sulfide, and the like. The adsorbent is disclosed as a Group VI B and/or Group VIII metal catalyst, for example, cobalt molybdate or nickel molybdate supported on alumina.

U.S. Pat. No. 3,367,862 to Mason et al., the disclosure of which is incorporated by reference, discloses a process for desulfurizing heavy residual petroleum fractions by contact with water in the presence of the catalyst comprising the metal, metal oxide, or metal sulfide, distended on a charred base.

Naphthas, which are used for reforming, typically contain between 50 wppm to 500 wppm sulfur as mercaptans, such as 2-propyl mercaptan, butyl mercaptan, and thiophene and hindered thiophenes, such as 2,5-dimethylthiophene. Accordingly, naphthas for reforming are usually treated with hydrogen over a hydrotreating catalyst, such as a sulfided cobalt and molybdenum on alumina support, or nickel and molybdenum on alumina support, to protect reforming catalysts. Hydrotreating converts sulfur compounds to hydrogen sulfide, decomposes nitrogen and oxygen compounds and saturates olefins. Hydrotreating is done at a temperature between about 400° F. and 900° F., a pressure between 200 psig and 750 psig, liquid hourly space velocity between 1 and 5, and hydrogen circulation rate of 500 to 3000 scf/hr. Modern hydrotreating processes can reduce the sulfur concentration in naphtha to 0.25 wppm and even to 0.1 wppm.

U.S. Pat. No. 3,898,153, the disclosure of which is incorporated by reference, is directed to purifying reformer feedstreams by passing hydrotreated reformer feedstock through a zinc oxide bed.

U.S. Pat. No. 4,634,518, the disclosure of which is incorporated by reference, passes hydrotreated reformer feed over massive nickel catalysts.

Other treatments for purifying hydrotreated feedstock for reforming are disclosed in U.S. Pat. Nos. 4,320,220, 4,225,417, 4,575,415, and 4,534,943, the disclosures of which are incorporated by reference, wherein the disclosed treatment is over manganese oxides.

A suitable manganese oxide formulation for this purpose which is commercially available is Sulfur Guard HRD-264 sold by Englehard Industries, wherein recommended treatment conditions are temperatures within the range of 600° F. to 1000° F., pressures within the range of about 150 psig to 700 psig, 1/1 to 30/1 hydrogen to oil molar ratio, and 500 to 50,000 ghsv.

U.S. Pat. No. 4,456,527, the disclosure of which is incorporated by reference, discloses purifying a hydrotreated feed for reforming over zeolite L catalysts.

U.S. Pat. No. 5,167,797 by John D. Y. Ou and assigned to Exxon, the disclosure of which is incorporated by reference, discloses a process for removal of sulfur contaminants from hydrocarbons using processes which rely upon the reaction of organosulfur compounds with N-halogeno-compounds. The sulfur removal may be effected by using liquid/liquid extraction processes or one of two reactive adsorption processes involving injecting a stoichiometric amount of one or more N-halogeno compounds into the hydrocarbon stream and then passing the stream through an adsorbent column to adsorb the N-halogeno-sulfur compounds and any unreacted N-halogeno compounds; or using adsorbents which are preloaded with N-halogeno compounds which are placed in a fixed-bed column for sulfur removal.

German Patent No. 3 527 110-A to Ciba Geigy A G, the disclosure of which is incorporated by reference, discloses removing hydrogen sulfide from gases by oxidation using a solution containing anthraquinone sulphonamide and variable valency metal compounds followed by reoxidation, preferably using oxygen of hydroquinone.

The process is disclosed as being useful to purify gas, town gas, waste gases, and $CO_2$ rich streams from coal combustion, wherein the impurities which may be present are identified as including certain oxides of C, N and S, $H_2S$, organic S compounds, and HCN.

British Patent No. 2 209 386 to Ciba Geigy A G, the disclosure of which is incorporated by reference, is directed to the removal of hydrogen sulfide from gases or liquid hydrocarbons by washing with alkaline solution containing anthraquinone disulphonamides. It is disclosed that hydrogen sulfide in gases is adsorbed, for subsequent removal in sulfur, by washing the gas with an aqueous alkaline solution of one or more anthraquinone sulphonamides.

European Application No. 74 894 to Cie Francaise Raffinage is directed to the extraction of hydrogen sulfide, carbon dioxide and the like, from hydrocarbon gases using sulfonamide or sulfamide as solvent. It is disclosed that undesirable gases, for example, $H_2S$, $CO_2$, COS, and mercaptans, are removed from their mixtures with hydrocarbons and/or $H_2$ by a solvent whose molecule contains at least one group N—$SO_2$, and, preferably a sulfonamide or sulfamide.

BRIEF SUMMARY OF THE INVENTION

The present invention provides a process to remove sulfur-containing compounds from hydrocarbon-containing streams by employing a liquid-liquid extraction of the hydrocarbon liquid phase with an aqueous phase containing a mixture of chemicals.

The process involves reactive extraction technology using a water-soluble mixture of low-cost industrial chemicals to react with thioethers and other sulfin species to form chlorosulfonium ions, sulfenyl chlorides, sulfoxides, sulfones, sulfonic acids, sulfilimines, and other heavier, ionic or water-soluble species to thereby separate and remove them from the hydrocarbon phase by trapping them in the aqueous phase.

The process of the present invention is based on the discovery of a new chemical reaction which involves the formation of sulfonium ions of thioethers and other sulfur species, in which chlorine is added to the sulfur as the chloronium ion ($Cl^+$) as a result of action by chloronium agents, including hypochlorites and chloramine species.

DETAILED DESCRIPTION OF THE INVENTION

Figure 1:
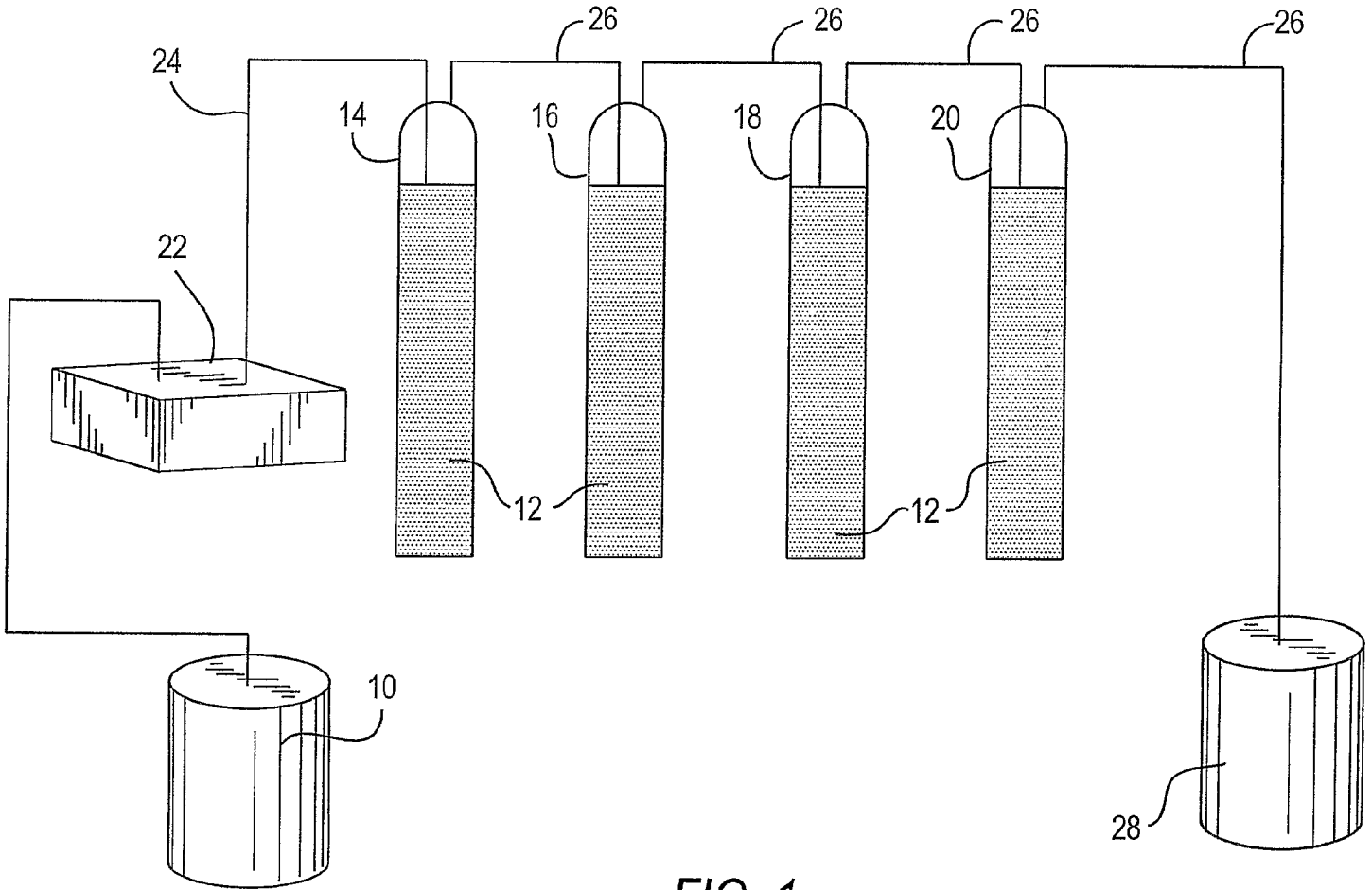
FIG. 1 is a schematic representation of an embodiment of the process of the present invention.

The process of the present invention relates to the removal of both organosulfur compounds and non-organosulfur compounds, hereinafter sulfur compounds, from a liquid hydrocarbon stream which comprises contacting said liquid hydrocarbon stream containing sulfur compounds with an extractive agent selected from the group consisting of chlorine-containing compounds, cyanuric acid and its salts, alkali and alkaline earth hydroxides, and mixtures thereof, optionally in the presence of a catalyst, under conditions and for a period of time which is effective to reduce the sulfur content of the hydrocarbon stream to 5 ppm or less.

Representative of the sulfur compounds removed by the process are hydrogen sulfide, carbon disulfide, carbonyl sulfide, mercaptans, thioethers, sulfides, disulfides, etc., from either a hydrocarbon gas (NG) stream, a liquefied natural gas (LNG) stream, a natural gas liquids (NGL), or a liquid hydrocarbon stream. The process comprises contacting said streams with an aqueous solution containing a mixture of agents selected from the group consisting of sodium hypochlorite, potassium hypochlorite, calcium hypochlorite, hypochlorous acid, chlorous acid, perchloric acid, chlorine dioxide, cyanuric acid, also known as syn-triazine-2,4,6-triol, 1,3,5-triazine-2,4,6(1H-3H-5H-) trione, syn-triazine triol, tricyanic acid, 2,4,6-trihydroxy-1,3,5-triazine trihydroxycyanidine, and its chlorinated forms and its sodium, potassium or calcium salts, including monochloro-, dichloro-, and trichloroisocyanurate and sodium; calcium and potassium hydroxide, and mixtures thereof.

While catalysis is optional, it is preferred from the standpoint of efficiency and speed. The reactive agents set forth above can be used in any combination, or individually, in various ratios, to their limits of solubility or stability, and the agents can be prepared beforehand or separately, or can be generated in situ, or by reacting the agents together.

The preferred extractive agents whether used alone or in combination are the hypochlorites of sodium and calcium, mono-, di-, and tri-chloroisocyanurate and sodium hydroxide.

When mono, di-, or tri-chloroisocyanurate is employed, it is preferably employed in combination with either sodium hydroxide, potassium hydroxide, calcium hydoxide or a hypochlorite in order to solubilize the chlorinated isocyanurate.

When a sodium hypochlorite solution is employed as the oxidizing chlorinating agent, its concentration should be about 0.1% to about 35%, by weight. Preferably, a concentration of about 1% to about 10%, should be employed. Most preferably, the concentration should be about 5% to about 6%.

The process may be catalyzed by the presence of ferrous sulfate, nickelous sulfate and other transition metal catalysts in their form as chloride salts, hypochlorite, chlorate, carbonate, nitrate, sulfite, or any other anion suitable for the purpose. Other catalysts which may be used are salts of molybdenum, cobalt, manganese, copper, chromium copper, tungsten, cerium, as well as other catalysts which are known to promote the oxidation and chlorination of sulfur. The catalyst may be in the form of soluble or insoluble salts, supported on silica, alumina, zeolites, or other known catalyst supports.

The use of nicklous or ferrous sulfate individually is preferred, with between about 50 mg/liter to about 1000 mg/liter being preferred, and 500 mg/liter being especially preferred.

The process can be carried out as a batch process, for example, in a CSTR (continuous stirred tank reactor) or as a continuous process using countercurrent reactors, static aqueous phase contactors or scrubbers, or as a continuous process by passing the hydrocarbon stream through an aqueous agent containing the chemicals listed above.

The process can be conducted at ambient temperature and pressure or at elevated temperature and pressure.

The process can include a post-treatment to remove reagents and by-products, such as chloride, chlorine, oxygen or chlorinated species. For example, a caustic wash after the reactor would be an optional or desirable provision in order to remove residual chlorine, hypochlorite or other undesirable species. A water wash may also be provided.

EXAMPLE 1

A stock solution of hydrocarbon containing butanes, pentanes and hexanes was prepared containing 82 mg/liter ethyl mercaptan, 84 mg/liter dimethyl sulfide, and 105 mg/liter dimethyl disulfide. Four extraction solutions were prepared as follows, where all concentrations are set forth in weight percent: Sodium Hypochlorite (5.25%); Trichloroisocyanurate (1.70%) and Sodium Hydroxide (2.00%); Calcium Hypochlorite (1.50%), and Sodium Hydroxide (1.59%).

A 10-ml sample of the stock solution was extracted separately by each of the reagent solutions for five minutes with intermittent shaking. The layers were allowed to settle, then an aliquot was withdrawn and analyzed by GC-SCD. The results appear in Table I and indicate the efficiency of each reagent mixture.

Sodium Hypochlorite (5.25%) was effective to remove more than 94% of ethyl mercaptan (ETSH) and dimethyl sulfide (DMS), and removed more than 78% of dimethyl disulfide (DMDS). Less than one mg/liter of methyl ethyl disulfide (MEDS), diethyldisulfide (DEDS), and an unknown disulfide were formed.

Trichloroisocyanurate (TCI) (1.70%) and Sodium Hydroxide (2.00%) removed 87% of ethyl mercaptan (ETSH), 98% of dimethyl sulfide (DMS), and removed only 20% of dimethyl disulfide (DMDS). Several mg/liter of methylethyl disulfide (MEDS), diethyldisulfide (DEDS), and an unknown disulfide were formed.

Calcium Hypochlorite (1.50%) removed over 99% of ethyl mercaptan (ETSH) and dimethyl sulfide (DMS), and removed only 40% of dimethyl disulfide (DMDS). About one mg/liter of methyl-ethyl disulfide and diethyldisulfide were formed.

Sodium Hydroxide (1.59%) removed 98% of the ethyl mercaptan (ETSH), but only removed 38% of the dimethyl sulfide (DMS) and 12% of the dimethyl disulfide (DMDS). Several mg/liter of methyl-ethyl disulfide, diethyl disulfide, and an unknown disulfide were formed.

The extractions, using the originally introduced extractants, were continued for one hour with intermittent shaking, then the layers were allowed to separate, and sample aliquots were withdrawn from each extraction hydrocarbon layer, and analyzed by GC-SCD (Gas Chromatography-Sulfur Chemiluminesence Detector). The results appear in Table II and indicate the efficiency of each reagent mixture.

Sodium Hypochlorite (5.25%) was effective to remove more than 96% of ethyl mercaptan and dimethyl sulfide, and removed more than 92% of dimethyl disulfide. Less than one mg/liter of methyl ethyl disulfide (MEDS), diethyl disulfide (DEDS), and an unknown disulfide were formed.

Trichloroisocyanurate (TCI)(1.70%) and Sodium Hydroxide (2.00%) removed 91% of ethyl mercaptan, 98% of dimethyl sulfide, and removed only 15% of dimethyl disulfide. Several mg/liter of methyl-ethyl disulfide, diethyl disulfide, and an unknown disulfide were formed.

Calcium Hypochlorite (1.50%) removed over 99% of ethyl mercaptan and dimethyl sulfide, and 95% of dimethyl disulfide. About one mg/liter of methyl-ethyl disulfide and diethyl disulfide were formed.

Sodium Hydroxide (1.59%) removed 98% of the ethyl mercaptan, but only removed 50% of the dimethyl sulfide and 26% of the dimethyl disulfide. Several mg/liter of methyl-ethyl disulfide, diethyl disulfide, and an unknown disulfide were formed.

TABLE I

CONCENTRATIONS FOUND AFTER FIVE MINUTE EXTRACTION

| SAMPLE | ETSH A | DMS A | DMDS A | EMDS | UNKN | DEDS |
|---|---|---|---|---|---|---|
| Retention Time | 1.42 | 1.57 | 7.21 | 9.93 | 10.68 | 12.75 |
| Stock Soln Mg/Liter | 82.2 | 83.9 | 104.6 | 0.0 | 0.0 | 0.0 |
| NaOCl 5.25% | 4.6 | 5.0 | 22.3 | 0.2 | 0.0 | 0.2 |
| TCl (1.70%) & NaOH (2.00%) | 10.7 | 1.3 | 84.1 | 5.6 | 1.8 | 13.4 |

TABLE I-continued

CONCENTRATIONS FOUND AFTER FIVE MINUTE EXTRACTION

| SAMPLE | ETSH A | DMS A | DMDS A | EMDS | UNKN | DEDS |
|---|---|---|---|---|---|---|
| $Ca(OCl)_2$ (1.50%) | 0.6 | 0.3 | 62.6 | 0.4 | 0.0 | 1.7 |
| NaOH (1.59%) | 1.4 | 52.3 | 92.1 | 6.3 | 0.0 | 4.6 |

TABLE II

CONCENTRATIONS FOUND AFTER ONE HOUR EXTRACTION

| SAMPLE | ETSH A | DMS A | DMDS A | EMDS | UNKN | DEDS |
|---|---|---|---|---|---|---|
| Retention Time | 1.42 | 1.57 | 7.21 | 9.93 | 10.68 | 12.75 |
| Stock Soln Mg/Liter | 82.2 | 83.9 | 104.6 | | | |
| NaOCl 5.25% | 3.4 | 2.9 | 8.0 | 0.2 | 0.0 | 0.2 |
| TCl (1.70%) & NaOH (2.00%) | 7.1 | 1.1 | 89.5 | 6.4 | 0.9 | 19.5 |
| $Ca(OCl)_2$ (1.50%) | 0.3 | 0.0 | 5.4 | 0.4 | 0.0 | 1.2 |
| NaOH (1.59%) | 0.8 | 41.7 | 77.1 | 14.4 | 0.3 | 24.6 |

EXAMPLE 2

A stock solution of 21 mg/liter ethyl mercaptan, 40 mg/liter dimethyl sulfide, and 71 mg/liter dimethyl disulfide in mixed hexanes was prepared. In this experiment, 10 ml of the stock solution was shaken with an aqueous extraction solution of 10 ml 5.25% NaOCl for five minutes in a 20 ml vial. The first sample was the stock solution. The second sample contained ferrous sulfate added at 500 mg/liter. The third sample contained nickelous sulfate at 500 mg/liter. The fourth sample contained 250 mg/liter ferrous sulfate and 250 mg/liter nickelous sulfate. The fifth sample contained only the NaOCl at 5.25%. After shaking the samples for five minutes, the samples were allowed to separate and the top layer was sampled, added to the injection vial, and analyzed by GC-SCD with a detection limit of 0.5 mg/liter sulfur. All concentrations are in mg/liter as sulfur.

As can be seen from an examination of Table III, when used separately, the ferrous and nickelous catalysts are both effective at removing sulfur to less than 0.5 ppm, or 99.5% removal. When mixed together, they are slightly less active, leaving a residue of 1 mg/liter of dimethyl disulfide. Sodium hypochlorite alone was very effective at removing all of the ethyl mercaptan and dimethyl sulfide, but only removed 53% of the dimethyl disulfide.

TABLE III

DMDS STK SLN = 71.21 MG/LITER SULFUR
RESPONSE FACTOR = 50937/71.21 = 715.3

| | ETSH | | DMS | | DMDS | |
|---|---|---|---|---|---|---|
| Sample | AREA | CONC | AREA | CONC | AREA | CONC |
| Retention Time | 1.17 | | 1.30 | | 6.43 | |
| Stock Solution | 19403 | 27.1 | 28732 | 40.2 | 50937 | 71.2 |
| NaOCl 5.25% & $Fe(SO_4)$ | 0.00 | 0.0 | 0.00 | 0.0 | 0 | 0.0 |
| NaOCl 5.25% & $Ni(SO_4)$ | 0.00 | 0.0 | 0.00 | 0.0 | 0 | 0.0 |
| NaOCl 5.25% & $Ni(SO_4)$ & Fe(SO4) | 0.00 | 0.0 | 0.00 | 0.0 | 731 | 1.0 |
| NaOCl Extn 5.25% | 0.00 | 0.0 | 0.00 | 0.0 | 24011 | 33.6 |

EXAMPLE 3

Referring to FIG. 1, a solution of light hydrocarbons containing butanes, pentanes and hexanes in feed tank 10 was treated with an extraction agent 12 using sparging chambers 14, 16, 18, and 20 as the contactor apparatus.

At the bottom of each of the sparging chambers, glass fritts, not shown, were provided which allowed the hydrocarbon solution to be pumped by pump 22 into the bottom of each of the chambers via line 24 and then into the reagent 12 to slowly disperse upwardly through extraction agent 12, and collecting at the top of each of the chambers where it was discharged into a collection line 26 and then collected in product tank 28.

Each of the chambers 14, 16, 18 and 20 were filled with extraction agent 12, which consisted of 250 ml of 5.25 weight % sodium hypochlorite, which contained 500 mg/liter of nickelous sulfate. The nickelous sulfate is present as a mostly dark blue solid, giving a slurry which is ebbulated by the action of the hydrocarbon solution passing through the aqueous layer.

The light hydrocarbon contained 30 mg/liter methyl mercaptan, 32 mg/liter ethyl mercaptan, 27 mg/liter dimethyl sulfide, 29 mg/liter isopropyl mercaptan (IPSH), and 148 mg/liter dimethyl disulfide.

Using an HPLC (High-Pressure Liquid Chromatography) pump 22, the hydrocarbon mixture was pumped from feed tank 10 into first sparging chamber 14 at a rate of 10 ml/minute. After 30 minutes, a sample was collected and analyzed by GC-SCD.

Second sparging chamber 16 was then added to the assembled apparatus and, again, the hydrocarbon was pumped at 10 ml/minute. After 30 minutes, a sample was collected and analyzed by GC-SCD.

A third sparging chamber 18 was then added to the assembled apparatus and, again, the hydrocarbon was pumped at 10 ml/minute. After 30 minutes, a sample was collected and analyzed by GC-SCD.

A fourth sparging chamber 20 was then added to the assembled apparatus and, again, the hydrocarbon was pumped at 10 ml/minute. After 30 minutes, a sample was collected and analyzed by GC-SCD.

The data which appear in attached Table IV show the increased reduction of sulfur components as each chamber is added (measured as mg. of sulfur/liter). After the third chamber, all of the sulfur compounds are eliminated, except for dimethyl disulfide, which is reduced by 40%. After the fourth chamber, all of the sulfur compounds are eliminated, except for dimethyl disulfide, which is reduced by 48%.

TABLE IV

| Sample | MTSH | ETSH | DMS | IPSH | DMDS |
|---|---|---|---|---|---|
| Retention Time | .75 | 1.17 | 1.30 | 2.40 | 6.43 |
| Stock Soln | 30.0 | 32.3 | 26.8 | 28.6 | 147.9 |
| First Chamber | 1.1 | 1.8 | 0.3 | 123.8 | 123.8 |
| Second Chamber | 0.3 | 0.4 | 0.0 | 0.7 | 110.9 |
| Third Chamber | 0.0 | 0.0 | 0.0 | 0.0 | 89.0 |
| Fourth Chamber | 0.0 | 0.0 | 0.0 | 0.0 | 77.5 |

EXAMPLE 4

Figure 2:
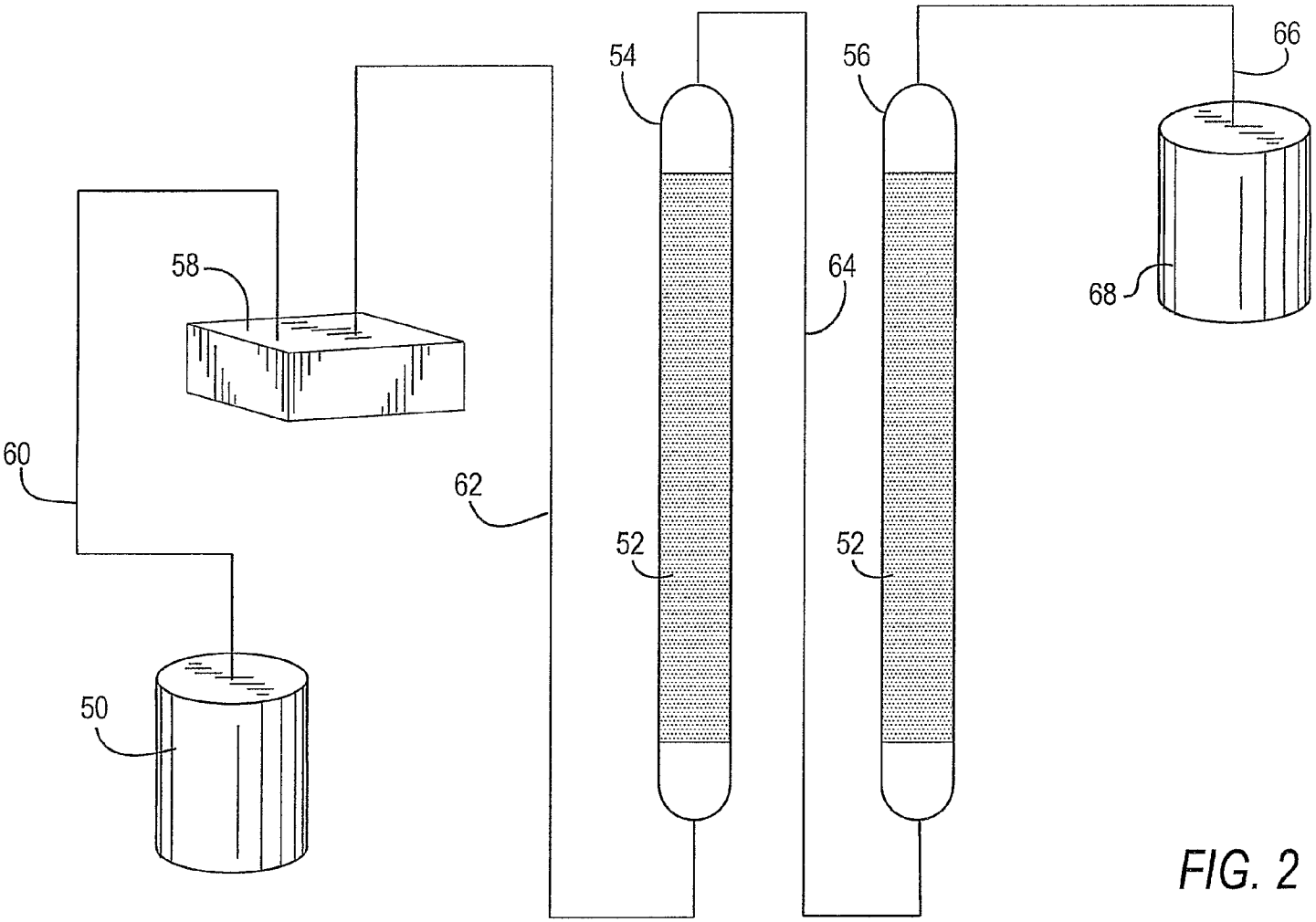
FIG. 2 is a schematic representation of another embodiment of the process of the present invention.

Referring to FIG. 2, a solution consisting of a mixture of light hydrocarbons containing-butanes, pentanes and hexanes in a feed tank 50 was treated with an extraction agent 52 using an apparatus consisting of two 40-inch chromatography columns 54 and 56 connected in series. A glass fritt, not shown, was located at the bottom of columns 54 and 56 which allowed the hydrocarbon mixture to be pumped from feed tank 50 by a high pressure liquid chromatography pump 58 via line 60, and thereafter via line 62 to the bottom of column 54 containing extraction agent 52 to slowly disperse upwardly therethrough, collecting at the top of the column 54 where it is discharged into line 64 and then pumped upwardly from the bottom of column 56 through extraction agent 52. A stopcock, not shown, located below the glass fritt, not shown, allowed the apparatus to be filled without leaking, or to be drained, or the flow to be interrupted.

The columns 54 and 56 are filled with extraction agent 52 consisting of 600 ml each of 5.25 weight % sodium hypochlorite and containing 500 mg/liter nickelous sulfate. The nickelous sulfate is present as a mostly insoluble dark blue solid, giving a slurry which is ebullated by the action of the hydrocarbon passing through the aqueous layer. The light hydrocarbon contained 38.1 mg/liter methyl mercaptan, 34.2 mg/liter ethyl dimethyl disulfide, 27.0 mg/liter dimethylsulfide, 25.1 mg/liter isopropyl mercaptan and 147.9 mg/liter dimethyl disulfide.

Using pump 58, the hydrocarbon mixture was pumped upwardly through the first column 54 and then upwardly through the second column 56 at a rate of 10 ml/minute. After the hydrocarbon first began to be discharged from the second column 56 via line 66, a sample was collected from product tank 68 and analyzed by GC-SCD. A second sample was collected after 30 minutes and a third sample was collected after 60 minutes.

In the first sample, as shown in Table V below, all of the sulfur components were removed, except for dimethyl disulfide, which was reduced by more than 88%. After 30 minutes, the sample showed all of the sulfur components had been removed except dimethyl disulfide, which was reduced by over 95%. After 60 minutes, the sample showed all of the sulfur components had been removed except dimethyl disulfide, which was reduced by over 99%. The data appears in the attached table.

TABLE V

| Sample | MTSH | ETSH | DMS | IPSH | DMDS |
|---|---|---|---|---|---|
| Stock Soln | 38.1 | 34.2 | 27.0 | 25.1 | 147.9 |
| Time 0 Minutes | 0.0 | 0.0 | 0.0 | 0.0 | 17.7 |
| Time 30 Minutes | 0.0 | 0.0 | 0.0 | 0.0 | 7.2 |
| Time 60 Minutes | 0.0 | 0.0 | 0.0 | 0.0 | 1.4 |

We claim:

1. A process for the removal of sulfur compounds from a hydrocarbon stream which comprises:

contacting the hydrocarbon stream containing sulfur compounds with an aqueous reactive extractive agent selected from the group consisting of a. one or more hypochlorites;

b. cyanuric acid and/or salts of cyanuric acid;

c. one or more hypochlorites in combination with cyanuric acid and/or salts of cyanuric acid;

d. one or more hypochlorites in combination with alkali metal and/or alkaline earth metal hydroxides;

e. cyanuric acid and/or salts of cyanuric acid in combination with alkali metal and/or alkaline earth metal hydroxides; and f. one or more hypochlorites in combination with cyanuric acid and/or salts of cyanuric acid, and alkali metal and/or alkaline earth metal hydroxides;

the hydrocarbon stream being contacted under conditions and for a period of time which is sufficient for the reaction between the reactive extractive agent and the sulfur compounds to form ionic reaction products which are soluble in water, said ionic reaction products forming in the aqueous solution;

whereby the sulfur content of the hydrocarbon stream is reduced by removal of the aqueous solution of ionic reaction products.

2. The process according to claim 1, wherein said hydrocarbon stream is selected from the group consisting of a hydrocarbon gas (NG) stream, a liquified natural gas (LNG) stream, a stream of natural gas liquids (NGL) and a liquid hydrocarbon stream.

3. The process according to claim 1, wherein said sulfur compounds present in the hydrocarbon stream include carbon disulfide, carbonyl sulfide, mercaptans, thioethers, sulfides, disulfides, and mixtures thereof.

4. The process according to claim 1, wherein the cyanuric acid and its salts of the aqueous reactive extractive agent (b), (c), (e) or (f) are selected from the group consisting of syn-triazine-2,4,6-triol, 1,3,5-triazine-2,4,6 (1H, 3H, 5H)-trione, syn-triazinetriol, 2,4,6-trihydroxy-1,3,5-triazine, trihydroxycyanidine, tricyanic acid, monochloroisocyanurate, dichloroisocyanurate, trichloroisocyanurate, sodium trichloroisocyanuric acid, and mixtures thereof.

5. The process according to claim 1, which includes contacting the hydrocarbon stream in the presence of a catalyst selected from the group consisting of transition metal oxidation catalysts and supported catalysts.

6. The process according to claim 5, wherein the transition metal catalysts are iron or nickel salts.

7. The process according to claim 6, wherein the iron or nickel salts are nickelous sulfate or ferrous sulfate.

8. The process according to claim 1, wherein the hydrocarbon stream is contacted in a continuous process by dispersing the hydrocarbon stream in the aqueous solution of the reactive extractive agent.

9. The process according to claim 8, which includes contacting the hydrocarbon stream in the presence of a catalyst selected from the group consisting of transition metal oxidation catalysts and supported catalysts.

10. The process according to claim 1, wherein the hydrocarbon stream is stirred and/or agitated in a contactor containing an aqueous solution of the reactive extractive agent.

11. The process according to claim 10, which includes contacting the hydrocarbon stream in the presence of a catalyst selected from the group consisting of transition metal oxidation catalysts and supported catalysts.

12. The process according to claim 1, wherein the sulfur content in the hydrocarbon stream is reduced to 5 ppm or less.

13. The process according to claim 1, wherein the one or more hypochlorites included in the aqueous reactive extractive agent (a), (c), (d) or (f) is selected from the group consisting of sodium hypochlorite, calcium hypochlorite, and hypochlorous acid.

14. The process according to claim 1, wherein the aqueous reactive extractive agent further comprises a salt or acid form of mixed oxides of chlorine selected from the group consisting of chlorous acid, perchloric acid, chlorine dioxide, and mixtures thereof.

15. The process according to claim 1, wherein the cyanuric acid and its salts of the aqueous reactive extractive agent (b), (c), (e) or (f) is one or more of monochloroisocyanurate, dichloroisocyanurate, or trichloroisocyanurate in combination with one or more of sodium hydroxide, potassium hydroxide, calcium hydroxide or a hypochlorite.

16. A process for the removal of one or more organosulfur compounds from a hydrocarbon stream, the process comprising:

contacting a liquid hydrocarbon stream containing the sulfur compounds with an aqueous reactive extractive agent that includes a hypochlorite, the hydrocarbon stream being contacted under conditions and for a period of time which is sufficient for the reaction between the reactive extractive agent and the one or more organosulfur compounds to form as ionic reaction products water soluble chlorosulfuonium ions in an aqueous solution, whereby the sulfur content of the hydrocarbon stream is reduced by removing the aqueous solution of ionic reaction products.

17. The process according to claim 16, wherein a chloronium ion combines with a sulfur atom of the one or more organosulfur compounds to form a water-soluble ionic sulfur compound.

* * * * *